US009314657B2

(12) United States Patent
Martinez

(10) Patent No.: US 9,314,657 B2
(45) Date of Patent: Apr. 19, 2016

(54) EXERCISE ASSEMBLY

(71) Applicant: Antonio L. Martinez, Tierra Amarilla, NM (US)

(72) Inventor: Antonio L. Martinez, Tierra Amarilla, NM (US)

( * ) Notice: Subject to any disclaimer, the term of this patent is extended or adjusted under 35 U.S.C. 154(b) by 0 days.

(21) Appl. No.: 14/293,807

(22) Filed: Jun. 2, 2014

(65) Prior Publication Data

US 2015/0343252 A1 Dec. 3, 2015

(51) Int. Cl.
*A63B 21/04* (2006.01)

(52) U.S. Cl.
CPC ..... *A63B 21/0428* (2013.01)

(58) Field of Classification Search
CPC ..... A63B 21/00003; A63B 21/00036; A63B 21/00047; A63B 21/00058; A63B 21/00065; A63B 21/00069; A63B 21/00087; A63B 21/0009; A63B 21/00094; A63B 21/00101; A63B 21/00109; A63B 21/0012; A63B 21/00123; A63B 21/00127; A63B 21/00174; A63B 21/00178; A63B 21/002; A63B 21/008; A63B 21/0081; A63B 21/0083; A63B 21/0085; A63B 21/0087; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/05; A63B 21/055; A63B 21/0552; A63B 21/08; A63B 21/1438; A63B 21/1446; A63B 21/1457; A63B 21/1461; A63B 21/1465; A63B 21/1469; A63B 21/1476; A63B 21/1488; A63B 21/1492; A63B 21/1496; A63B 21/15; A63B 21/158; A63B 23/12; A63B 23/1209; A63B 23/1245; A63B 23/1281; A63B 23/129; A63B 23/14; A63B 2208/0228; A63B 2208/0233; A63B 21/00007; A63B 21/045; A63B 21/0455; A63B 21/0555; A63B 21/0557; A63B 21/151
USPC ..... 482/905
See application file for complete search history.

(56) References Cited

U.S. PATENT DOCUMENTS

| | | | | | |
|---|---|---|---|---|---|
| 911,925 | A | * | 2/1909 | Del Valle Y Zeno | 73/379.08 |
| 929,281 | A | * | 7/1909 | Brodeur | 73/379.08 |
| 2,782,033 | A | * | 2/1957 | Ugartechea | 482/129 |
| 3,019,019 | A | * | 1/1962 | Forte | 482/94 |
| 3,059,476 | A | * | 10/1962 | Spradlin | 73/379.08 |
| 3,294,399 | A | * | 12/1966 | Cugliari | 482/94 |
| 3,467,376 | A | * | 9/1969 | Feinberg | 273/452 |
| 3,475,024 | A | * | 10/1969 | Lewis | 482/97 |
| 3,559,487 | A | * | 2/1971 | Parlato | 73/379.08 |
| 3,563,542 | A | | 2/1971 | Wellman | |
| 3,633,907 | A | * | 1/1972 | Cane et al. | 482/123 |
| 3,649,010 | A | * | 3/1972 | Jeffrey et al. | 273/452 |
| 3,662,602 | A | * | 5/1972 | Weiss | 73/379.08 |
| 3,735,983 | A | * | 5/1973 | Ortiz | 273/452 |
| 3,743,284 | A | * | 7/1973 | Rhodes et al. | 273/451 |

(Continued)

*Primary Examiner* — Oren Ginsberg
*Assistant Examiner* — Gary D Urbiel Goldner

(57) ABSTRACT

An exercise assembly for allowing a user to practice the sport of arm wrestling includes a table that may be positioned on a support surface. A support arm is coupled to the table. The support arm extends upwardly from the table. A spring biasing member is coupled to the support arm. A handle is coupled to the spring biasing member. The handle is oriented at an angle with respect to the spring biasing member. The user's hand and forearm are positioned in the convention of arm wrestling when the user grips the handle. A piston is coupled to the table. A rod is coupled between the piston and the handle. The user urges the handle downwardly toward the table. The user simultaneously stretches the spring biasing member and compresses the piston so the user is trained in the sport of arm wrestling.

13 Claims, 6 Drawing Sheets

(56) References Cited

U.S. PATENT DOCUMENTS

| | | | | | |
|---|---|---|---|---|---|
| 3,815,904 | A | * | 6/1974 | Weiss et al. | 482/123 |
| D237,634 | S | * | 11/1975 | Ricketts | D21/677 |
| 3,947,025 | A | * | 3/1976 | Hobby, Jr. | 482/123 |
| 3,953,026 | A | * | 4/1976 | Stokely | 482/123 |
| 3,982,757 | A | * | 9/1976 | McDonnell | 482/123 |
| 4,063,727 | A | * | 12/1977 | Hall | 482/130 |
| 4,068,843 | A | | 1/1978 | Frost | |
| 4,129,297 | A | * | 12/1978 | Dolan | 482/123 |
| 4,131,275 | A | * | 12/1978 | Gandy et al. | 273/451 |
| 4,157,179 | A | * | 6/1979 | Ecklor, Jr. | 482/130 |
| 4,162,068 | A | * | 7/1979 | Berg | 273/452 |
| 4,171,801 | A | * | 10/1979 | Bell | 482/118 |
| 4,176,837 | A | * | 12/1979 | Jeffrey et al. | 273/452 |
| 4,184,675 | A | * | 1/1980 | Rogerson | 482/113 |
| 4,209,167 | A | * | 6/1980 | Jansen | 482/123 |
| 4,214,748 | A | | 7/1980 | Blackmon | |
| D256,822 | S | * | 9/1980 | Ozzimo | D21/677 |
| 4,220,330 | A | * | 9/1980 | Montgomery | 273/452 |
| 4,316,609 | A | | 2/1982 | Silberman | |
| D264,236 | S | * | 5/1982 | Vyhlidal | D21/677 |
| 4,327,910 | A | * | 5/1982 | Mackie | 273/452 |
| 4,343,465 | A | * | 8/1982 | Allen | 482/123 |
| 4,351,523 | A | | 9/1982 | Alexander | |
| 4,377,282 | A | * | 3/1983 | Hayes | 482/44 |
| 4,406,454 | A | * | 9/1983 | Dean | 273/451 |
| 4,423,862 | A | * | 1/1984 | Hewitt | 482/130 |
| 4,425,797 | A | * | 1/1984 | Morrison | 73/379.01 |
| 4,427,194 | A | * | 1/1984 | Dion | 273/451 |
| 4,461,474 | A | * | 7/1984 | Retzlaff | 482/123 |
| 4,463,949 | A | * | 8/1984 | McCoy et al. | 273/451 |
| 4,509,747 | A | * | 4/1985 | Martin | 482/123 |
| 4,557,481 | A | * | 12/1985 | McClure | 273/452 |
| 4,564,191 | A | * | 1/1986 | Atkin | 482/130 |
| 4,575,076 | A | * | 3/1986 | Reichert et al. | 273/453 |
| 4,577,857 | A | * | 3/1986 | Dion | 273/453 |
| 4,634,115 | A | * | 1/1987 | Hawkins | 482/123 |
| 4,754,964 | A | * | 7/1988 | Michaels | 482/112 |
| 4,772,015 | A | * | 9/1988 | Carlson et al. | 482/92 |
| 4,805,900 | A | * | 2/1989 | Sapp | 482/112 |
| 4,811,944 | A | * | 3/1989 | Hoff | 482/94 |
| 4,846,468 | A | * | 7/1989 | McCoy et al. | 273/451 |
| 4,900,019 | A | * | 2/1990 | Shamir | 482/123 |
| 5,050,872 | A | | 9/1991 | Farenholtz | |
| 5,087,031 | A | * | 2/1992 | Hoff | 482/46 |
| 5,087,038 | A | * | 2/1992 | Hao et al. | 482/130 |
| 5,184,994 | A | * | 2/1993 | Morris et al. | 482/129 |
| 5,431,616 | A | | 7/1995 | Centofante | |
| 5,458,554 | A | * | 10/1995 | Lo | 482/123 |
| 5,499,960 | A | * | 3/1996 | Chen | 482/116 |
| 5,613,927 | A | * | 3/1997 | Rothacker | 482/123 |
| 5,655,769 | A | * | 8/1997 | Arcari | 273/110 |
| 5,842,958 | A | * | 12/1998 | Rufa | 482/112 |
| 6,165,109 | A | * | 12/2000 | Plamann | 482/97 |
| 6,958,032 | B1 | * | 10/2005 | Smith et al. | 482/121 |
| 7,150,682 | B2 | * | 12/2006 | Varner | 473/257 |
| 2002/0107120 | A1 | * | 8/2002 | Meller et al. | 482/122 |
| 2004/0023763 | A1 | * | 2/2004 | Sleiman | 482/126 |
| 2006/0258518 | A1 | * | 11/2006 | Kessler | 482/112 |
| 2007/0129223 | A1 | * | 6/2007 | Kolomeir | 482/112 |
| 2007/0142187 | A1 | * | 6/2007 | Kolomeir | 482/92 |
| 2009/0239720 | A1 | * | 9/2009 | Osbak | 482/112 |

* cited by examiner

EXERCISE ASSEMBLY

BACKGROUND OF THE DISCLOSURE

Field of the Disclosure

The disclosure relates to exercise devices and more particularly pertains to a new exercise device for allowing a user to practice the sport of arm wrestling.

SUMMARY OF THE DISCLOSURE

An embodiment of the disclosure meets the needs presented above by generally comprising a table that may be positioned on a support surface. A support arm is coupled to the table. The support arm extends upwardly from the table. A spring biasing member is coupled to the support arm. The spring biasing member is positioned above the table. A handle is coupled to the spring biasing member. The handle is oriented at an angle with respect to the spring biasing member. The user's hand and forearm are positioned in the convention of arm wrestling when the user grips the handle. A piston is coupled to the table. A rod is coupled between the piston and the handle. The user urges the handle downwardly toward the table. The user simultaneously stretches the spring biasing member and compresses the piston so the user is trained in the sport of arm wrestling.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
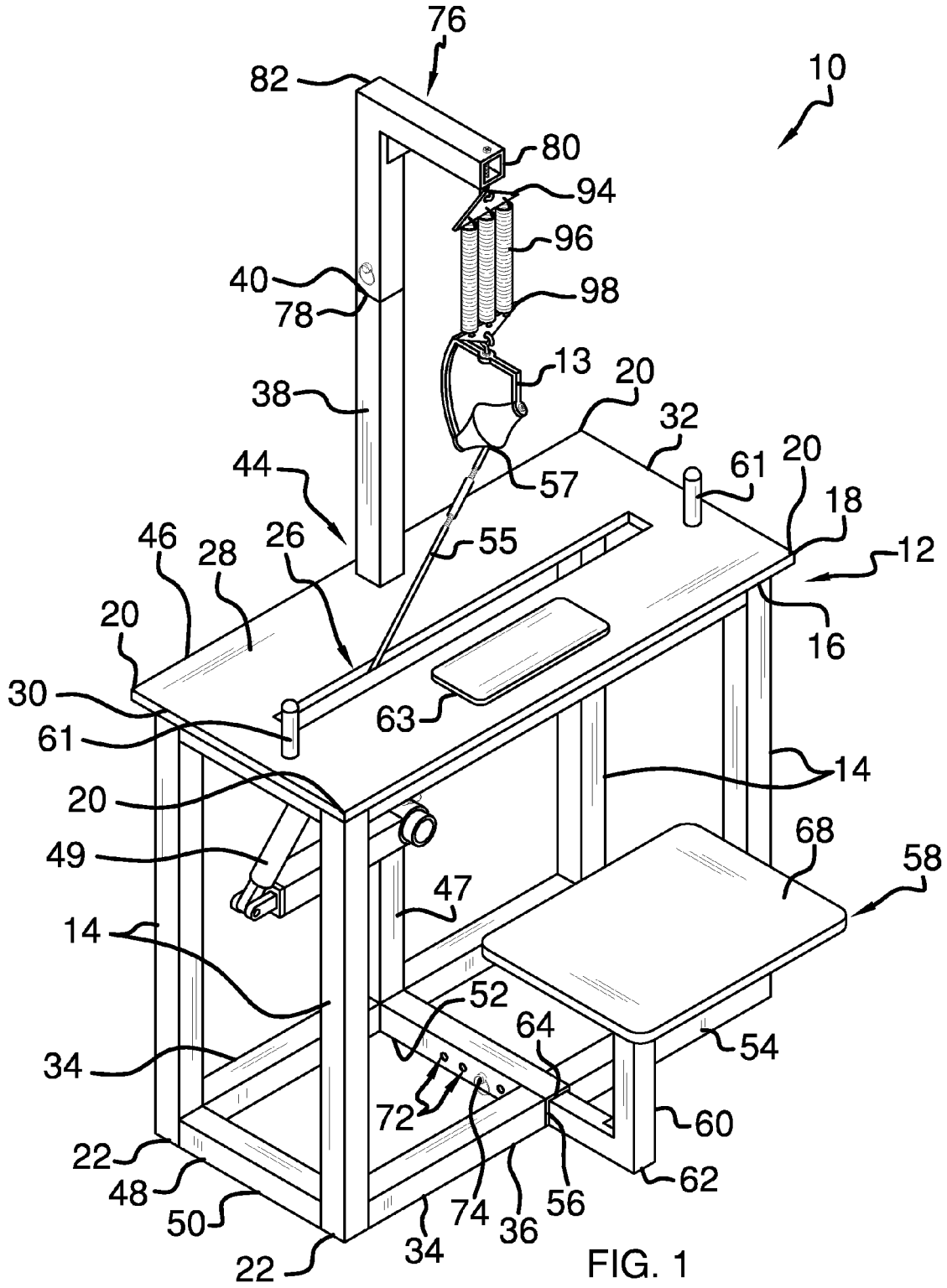
FIG. 1 is a perspective view of an exercise assembly according to an embodiment of the disclosure.
Figure 2:
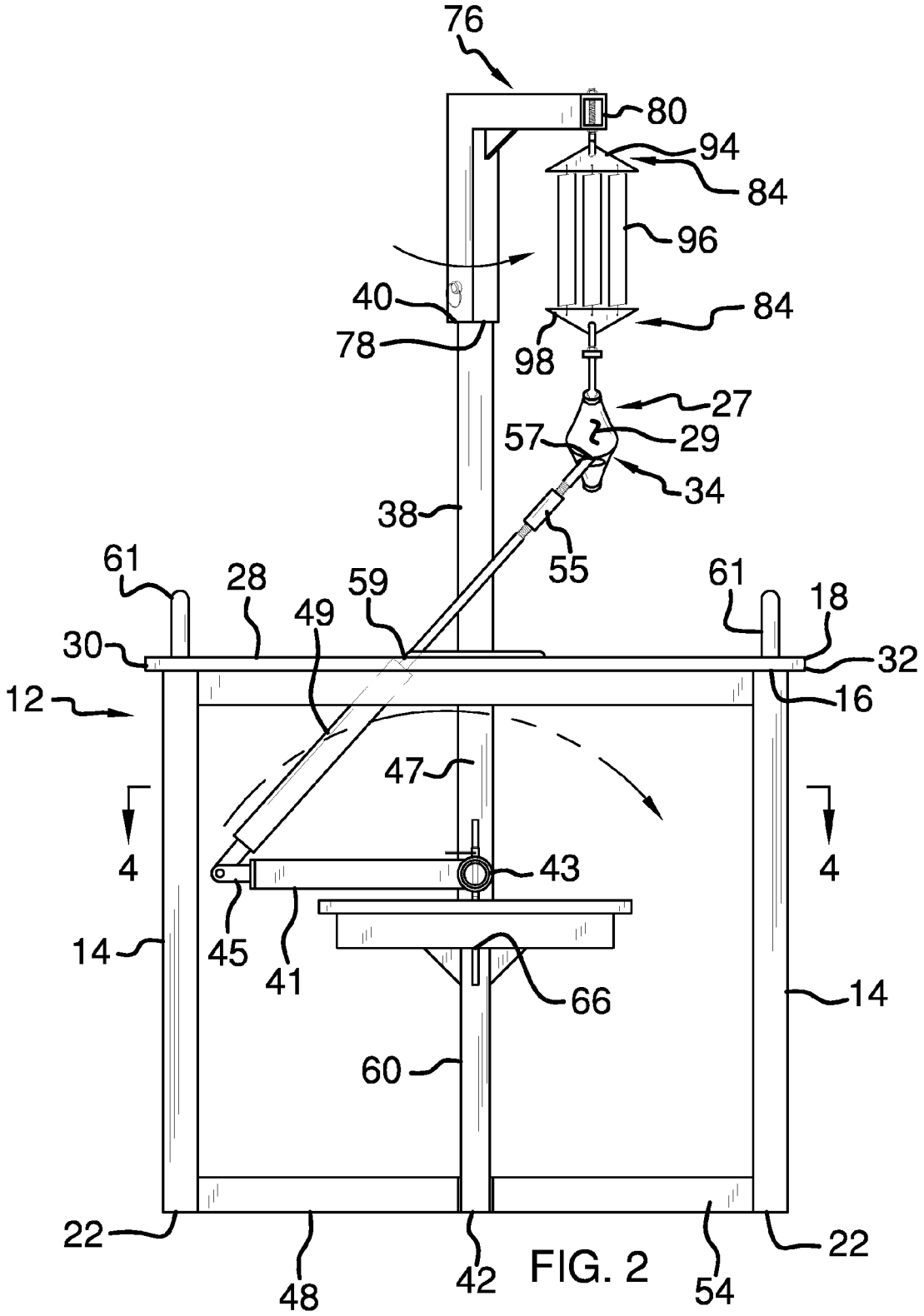
FIG. 2 is a front view of an embodiment of the disclosure.
Figure 3:
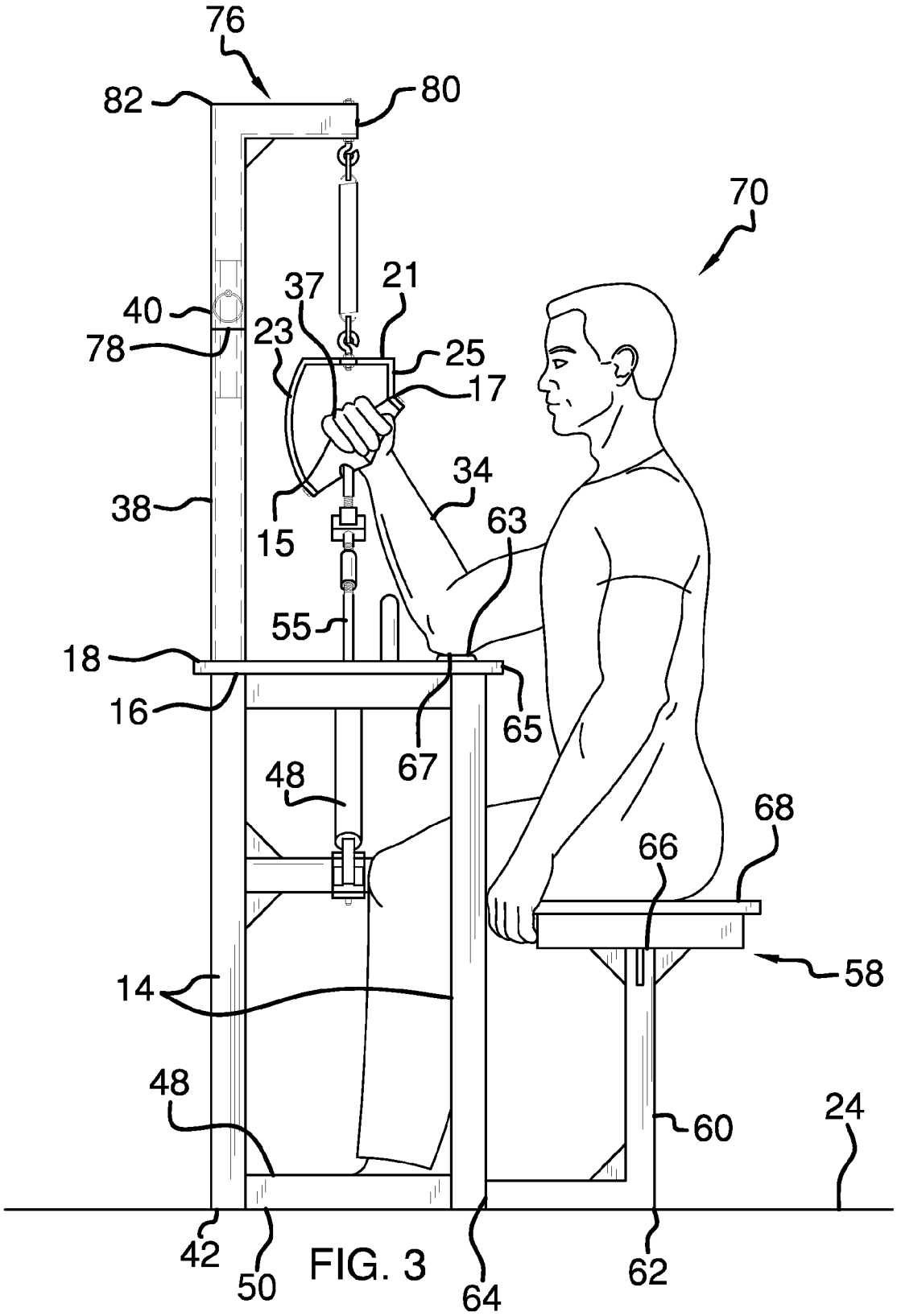
FIG. 3 is a left side view of an embodiment of the disclosure.
Figure 4:
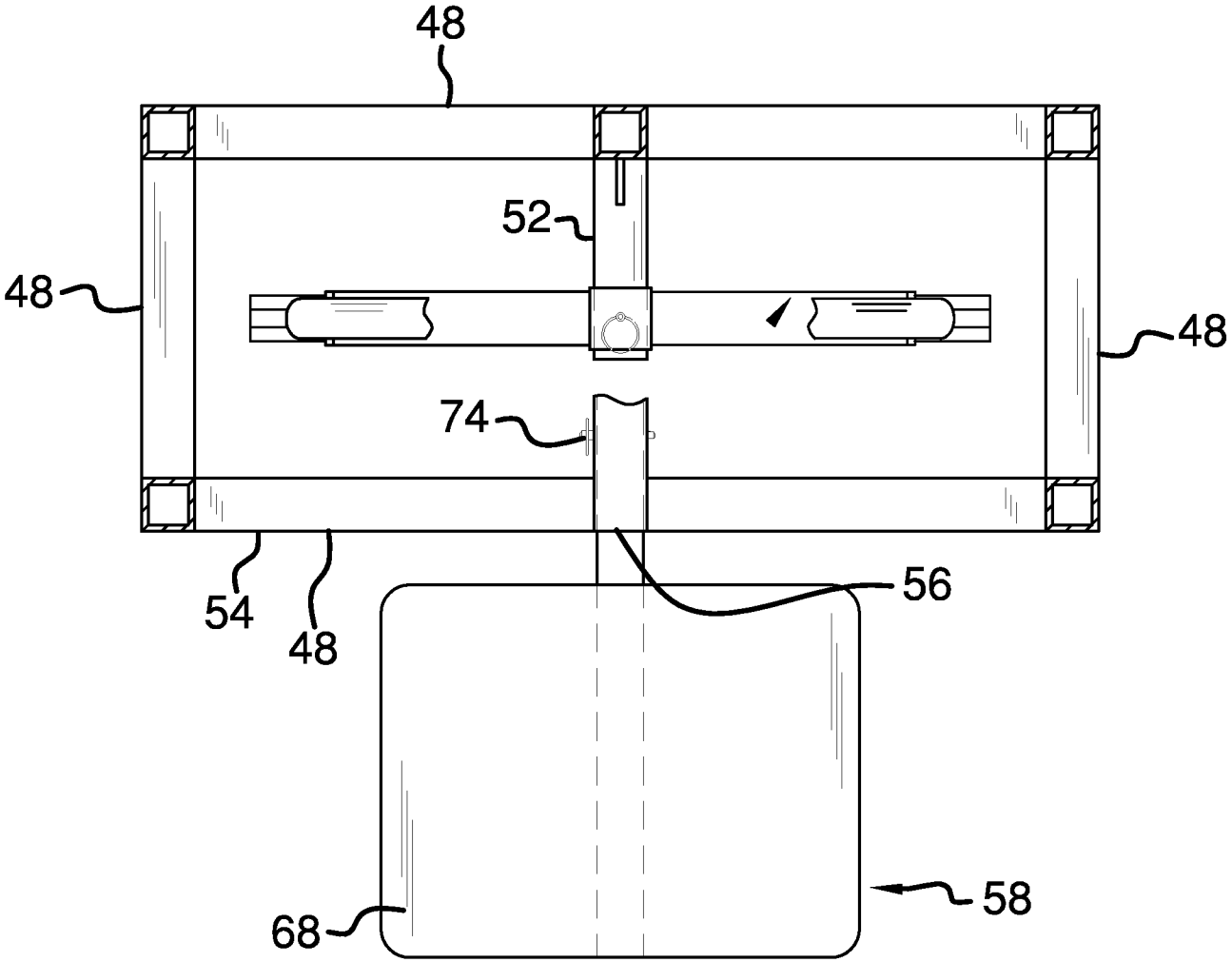
FIG. 4 is a cross sectional view taken along line 4-4 of FIG. 2 of an embodiment of the disclosure.
Figure 5:
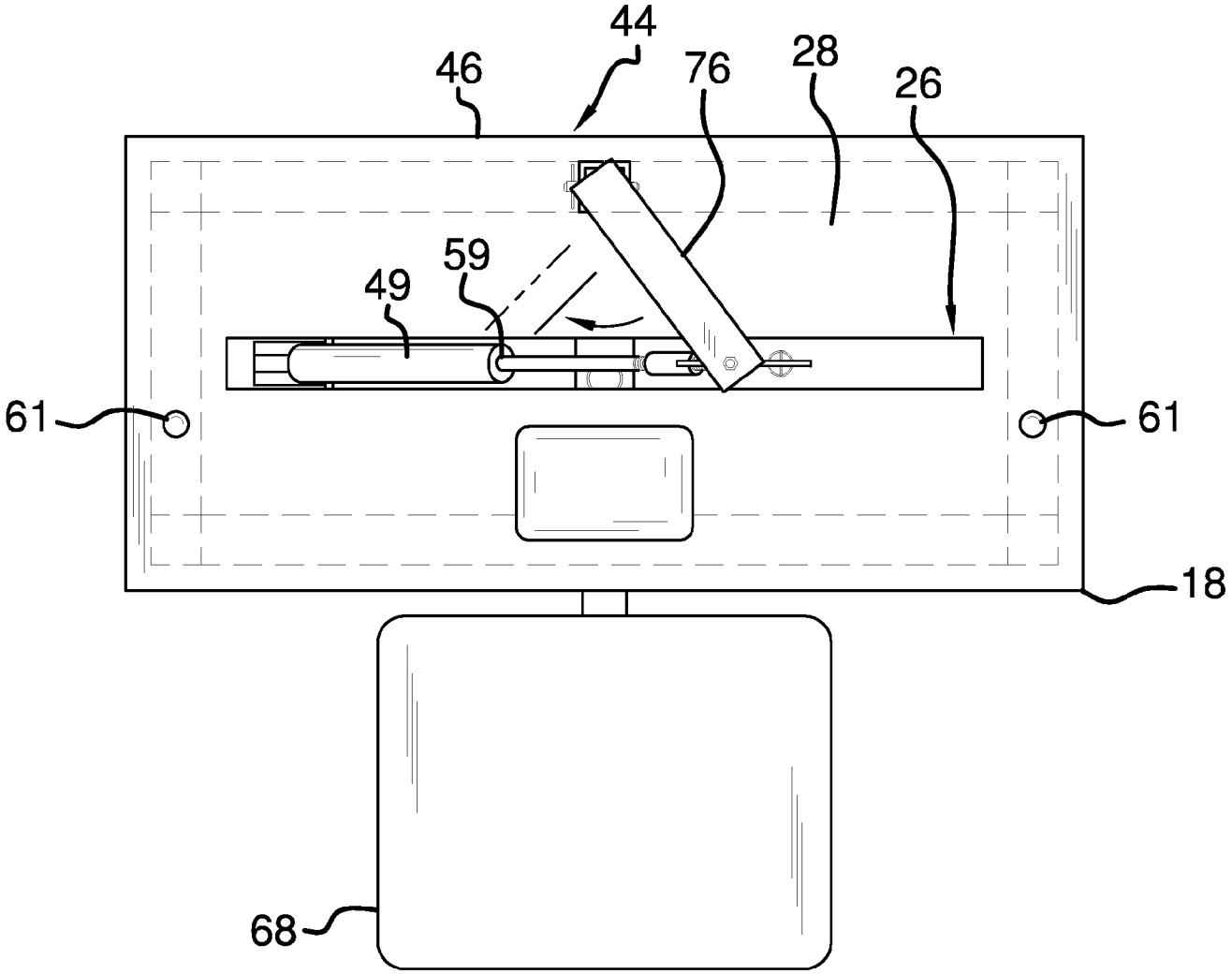
FIG. 5 is a top view of an embodiment of the disclosure.
Figure 6:
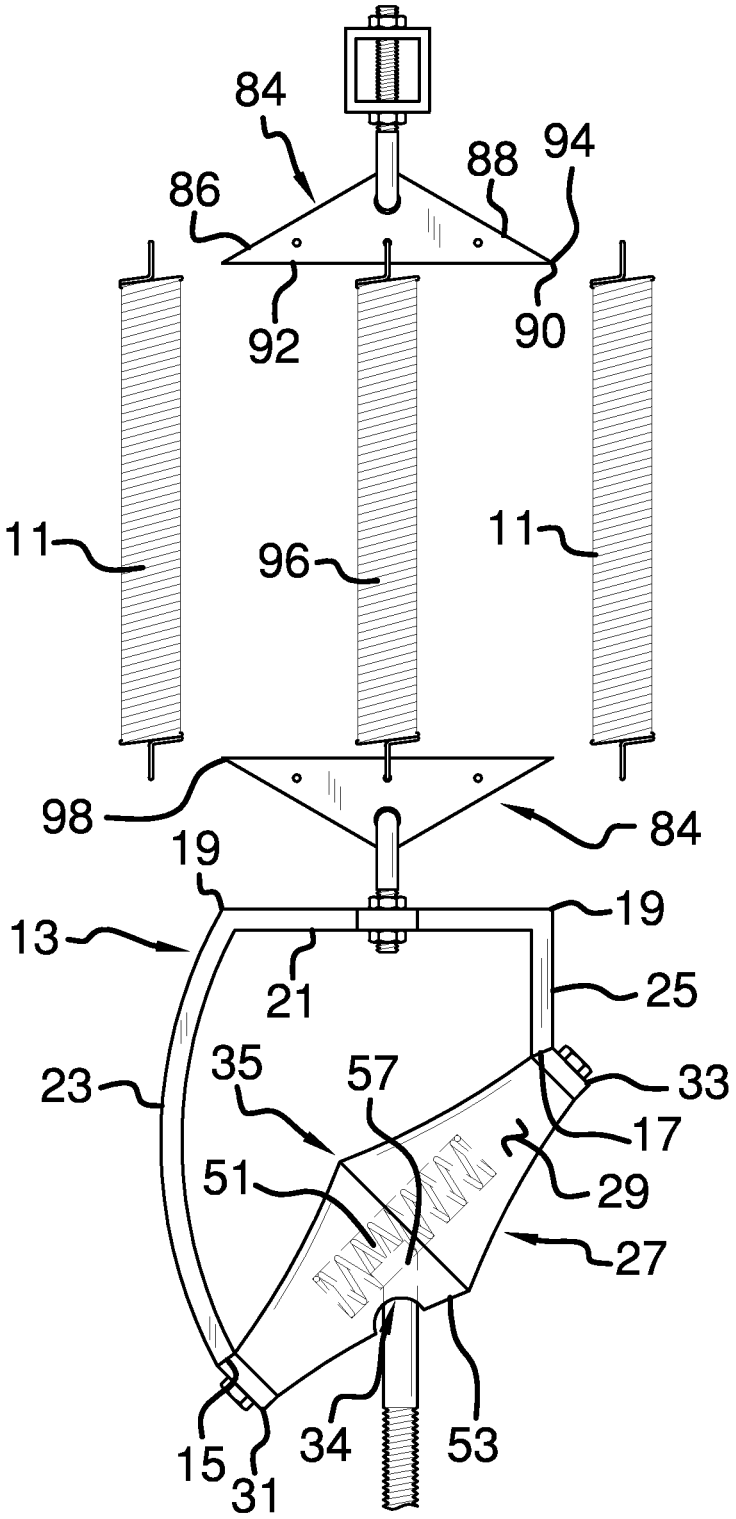
FIG. 6 is a front perspective view of a spring biasing member of an embodiment of the disclosure.

With reference now to the drawings, and in particular to FIGS. 1 through 6 thereof, a new exercise device embodying the principles and concepts of an embodiment of the disclosure and generally designated by the reference numeral 10 will be described.

As best illustrated in FIGS. 1 through 6, the exercise assembly 10 generally comprises a table 12. The table has a plurality of legs 14 coupled to and extending downwardly from a bottom side 16 of a top 18 of the table 12. Each of the plurality of legs 14 is positioned proximate an associated one of four corners 20 of the top 18 of the table 12. A lower end 22 of each of the plurality of legs 14 abuts a support surface 24. The top 18 of the table 12 is supported above the support surface 24. The support surface 24 may be ground.

The top 18 of the table 12 has a slot 26 extending through a top side 28 and the bottom side 16 of top 18 of the table 12. The slot 26 extends between each of a first lateral edge 30 and a second lateral edge 32 of the top 18 of the table 12. A support arm 38 is provided. The support arm 38 has a top end 40 and a bottom end 42. The support arm 38 extends upwardly through the top 18 of the table 12. The support arm 38 is positioned proximate a middle 44 of a rear edge 46 of the top 18 of the table 12. The bottom end 42 of the support arm 38 abuts the support surface 24. The top end 40 of the support arm 38 is spaced upwardly from the top 18 of the table 12.

A plurality of basal arms 48 each extends between the lower end 22 of an associated one of each of the plurality of legs 14. The plurality of basal arms 48 forms a rectangular shape. A bottommost side 50 of each of the plurality of basal arms 48 abuts the support surface 24. A medial arm 52 extends between the bottom end 42 of the support arm 38 and a front one 54 of the plurality of basal arms 48. An exposed end 56 of the medial arm 52 is open.

A stool 58 is provided. The stool 58 includes a stool arm 60 having a bend 62 thereon such that the stool arm 60 has an L-shape. The exposed end 56 of the medial arm 52 insertably receives an inserted end 64 of the stool arm 60. A seat end 66 of the stool arm 60 is directed upwardly from the support surface 24. A seat 68 is coupled to the seat end 66 of the stool arm 60. A user 70 sits on the seat 68.

The medial arm 52 has a plurality of pin apertures 72 extending laterally through the medial arm 52. The plurality of pin apertures 72 is evenly spaced apart. A pin 74 is extendable through a selected one of the plurality of pin apertures 72. The pin 74 engages the stool arm 60 so the seat 68 is retained at a selected distance away from the table 12.

A retention arm 76 has a coupled end 78 and a free end 80. The retention arm 76 has a bend 82 thereon such that the retention arm 76 has an L-shape. The coupled end 78 of the retention arm 76 insertably receives the top end 40 of the support arm 38. The retention arm 76 is rotatably coupled to the support arm 38. The free end 80 of the retention arm 76 is directed forwardly from the support arm 38.

A pair of plates 84 is provided. A first oblique side 86 and a second oblique side 88 of an outer edge 90 of the pair of plates 84 extends upwardly at an angle from a lowermost side 92 of the outer edge 90 of each of the pair of plates 84. Each of the pair of plates 84 has a triangular shape. An intersection of the first 86 and second 88 oblique sides of the outer edge 90 of a first one 94 of the pair of plates 84 is coupled to the free end 80 of the retention arm 76.

A spring biasing member 96 is coupled the lowermost side 92 of the outer edge 90 of the first plate 94. A second one 98 of the pair of plates 84 is inverted with respect to the first plate 94. The spring biasing member 96 extends between the lowermost side 92 of the outer edge 90 of each of the first 94 and second 98 plates. The spring biasing member 96 is positioned above the top 18 of the table 12. Moreover, the spring biasing member 96 may be one of a plurality of the spring biasing members 11.

A handle mount 13 has a first end 15 and a second end 17. The handle mount 13 has a pair of bends 19 thereon such that the handle mount 13 has a U-shape. A central arm 21 of the handle mount 13 is coupled to an intersection of the first 86 and second 88 oblique sides of the outer edge 90 of the second plate 98. A rear arm 23 of the handle mount 13 is curved. The first end 15 of the handle mount 13 is directed toward the second end 17 of the handle mount 13. The rear arm 23 of the handle mount 13 has a length that is greater than a length of a front arm 25 of the handle mount 13.

A handle 27 has an outer surface 29 extending between a primary end 31 and a secondary end 33 of the handle 27. The outer surface 29 of the handle 27 flares outwardly proximate a center 35 of the handle 27. The center 35 of the handle 27 has a diameter that is greater than a diameter of each of the primary 31 and secondary 33 ends of the handle 27. Each of the primary 31 and secondary 33 ends of the handle 27 is coupled to an associated one of the first 15 and second 17 ends of the handle mount 13. The handle 27 is oriented at an angle with respect to the spring biasing member 96. The user's hand 37 and forearm 39 are positioned in the convention of arm wrestling when the user 70 grips the handle 27.

A piston arm 41 is provided. The piston arm 41 has a leading end 43 and a following end 45. The leading end 43 of the piston arm 41 is rotatably coupled to a front side 47 of the support arm 38. The piston arm 41 is positioned beneath the top 18 of the table 12.

A piston 49 is rotatably coupled to the following end 45 of the piston arm 41. The piston 49 extends upwardly from the piston arm 41 toward the bottom side 16 of the top of 18 the table 12. The piston 49 may be a hydraulic cylinder of any conventional design.

A spring 51 is positioned within an interior of the handle 27. The spring 51 extends between the primary 31 and secondary 33 ends of the handle 27. The outer surface 29 of the handle has a slot 34 extending therethrough. The slot 34 extends between the primary 31 and secondary 33 ends of the handle 27. Additionally, the slot 34 is positioned on a basal side 53 of the outer surface 29 of the handle 27.

A rod 55 has a principle end 57 and an alternative end 59. The rod 55 is elongated. The rod 55 extends through the slot 34 in the handle 27. The principle end 57 of the rod 55 is coupled to the spring 51 in the handle 27. The alternative end 59 of the rod 55 is coupled to the piston 49. The rod 55 extends through the slot 26 in the top 18 of the table 12.

A pair of pegs 61 is each coupled to and extends upwardly from the top side 28 of the top 18 of the table 12. Each of the pair of pegs 61 is positioned proximate an associated one of the first 30 and second 32 lateral edges of the top 18 of the table 12. A pad 63 is coupled to the top 18 of the table 12. The pad 63 is positioned proximate a front edge 65 of the top 18 of the table 12. Additionally, the pad 63 is centrally positioned between the pair of pegs 61.

In use, the user 70 sits on the seat 68. The user 70 grips the handle 27 with one of the user's hands 37 and grips a selected one of the pair of pegs 61 with the other one of the user's hands 37. The user 70 places the user's elbow 67 on the pad 61 and the user 70 urges the handle 27 downwardly toward the table 12. Moreover, the user 70 simultaneously stretches the spring biasing member 96 and compresses the piston 49. The user 70 repeats the motion of urging the handle 27 downwardly toward the table 12 and releasing the handle 27 toward the retention arm 76.

The piston arm 41 is positionable between a left hand and a right hand position. The piston arm 41 extends toward the first lateral edge 30 of the top 18 of the table 12 in the right hand position. The piston arm 41 extends toward the second lateral edge 32 of the top 18 of the table 12 in the left hand position. The user 70 grips the handle 27 with the user's right hand 37 when the piston arm 41 is positioned on the right hand position. Alternatively, the user 70 grips the handle 27 with the user's left hand 37 when the piston arm 41 is positioned in the left hand position. The user 70 repeatedly urges the handle 27 downwardly so the user 70 is trained in the sport of arm wrestling.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercise assembly configured to allow a user to practice the sport of arm wrestling, said assembly comprising:

a table configured to be positioned on a support surface;

a support arm coupled to said table such that said support arm extends upwardly from said table;

a spring biasing member coupled to said support arm such that said spring biasing member is positioned above said table;

a handle coupled to said spring biasing member, said handle being oriented at an angle with respect to said spring biasing member and configured such that the user's hand and forearm are positioned in the convention of arm wrestling when the user grips said handle;

a piston coupled to said table;

a rod coupled between said piston and said handle;

wherein said assembly is configured to allow the user to urge said handle downwardly toward said table having the user simultaneously stretching said spring biasing member and compressing said piston such that the user is trained in the sport of arm wrestling; and a piston arm having a leading end and a following end, said leading end of said piston arm being rotatably coupled to a front side of said support arm such that said piston arm is positioned beneath a top of said table.

2. The assembly according to claim 1, further comprising:

said table having a plurality of legs coupled to and extending downwardly from a bottom side of a top of said table;

each of said plurality of legs being positioned proximate to an associated one of four corners of said top of said table; and a lower end of each of said plurality of legs abutting the support surface such that said top of said table is supported above the support surface.

3. The assembly according to claim 1, further comprising:

said support arm having a top end and a bottom end;

said support arm extending upwardly through a top of said table such that said support arm is positioned proximate to a middle of a rear edge of said top of said table; and said bottom end of said support arm abutting the support surface and said top end of said support arm being spaced upwardly from said top of said table.

4. The assembly according to claim 1, further comprising:

a retention arm having a coupled end and a free end;

said retention arm having a bend thereon such that said retention arm has an L-shape; and said coupled end of said retention arm insertably receiving a top end of said support arm such that said free end of said retention arm is directed forwardly from said support arm.

5. The assembly according to claim 1, further comprising a pair of plates, a first plate of said pair of plates being coupled to a free end of a retention arm, said spring biasing member being coupled between said first plate and a second plate of said pair of plates.

6. The assembly according to claim 1, further comprising:

a handle mount having a first end and a second end;

said handle mount having a pair of bends thereon such that said handle mount has a U-shape; and a central arm of said handle mount being coupled to a plate.

7. The assembly according to claim 6, further comprising a rear arm of said handle mount being curved such that said first end of said handle mount is directed toward said second end of said handle mount, said rear arm of said handle mount having a length being greater than a length of a front arm of said handle mount.

8. The assembly according to claim 1, further comprising said handle having an outer surface extending between a primary end and a secondary end of said handle, said outer surface of said handle flaring outwardly proximate to a center of said handle such that said center of said handle has a diameter being greater than a diameter of each of said primary and secondary ends of said handle.

9. The assembly according to claim 1, further comprising each of a primary and a secondary end of said handle being coupled to an associated one of a first end and a second end of a handle mount.

10. An exercise assembly configured to allow a user to practice the sport of arm wrestling, said assembly comprising:

a table configured to be positioned on a support surface;

a support arm coupled to said table such that said support arm extends upwardly from said table;

a spring biasing member coupled to said support arm such that said spring biasing member is positioned above said table;

a handle coupled to said spring biasing member, said handle being oriented at an angle with respect to said spring biasing member and configured such that the user's hand and forearm are positioned in the convention of arm wrestling when the user grips said handle;

a piston coupled to said table;

a rod coupled between said piston and said handle;

wherein said assembly is configured to allow the user to urge said handle downwardly toward said table having the user simultaneously stretching said spring biasing member and compressing said piston such that the user is trained in the sport of arm wrestling; and said piston being rotatably coupled to a following end of a piston arm such that said piston extends upwardly from said piston arm toward a bottom side of a top of said table.

11. The assembly according to claim 1, further comprising a top of said table having a slot extending through a top side of said top of said table and a bottom side of said top of said table, said slot extending between each of a first lateral edge and a second lateral edge of said top of said table.

12. An exercise assembly configured to allow a user to practice the sport of arm wrestling, said assembly comprising:

a table configured to be positioned on a support surface;

a support arm coupled to said table such that said support arm extends upwardly from said table;

a spring biasing member coupled to said support arm such that said spring biasing member is positioned above said table;

a handle coupled to said spring biasing member, said handle being oriented at an angle with respect to said spring biasing member and configured such that the user's hand and forearm are positioned in the convention of arm wrestling when the user grips said handle;

a piston coupled to said table;

a rod coupled between said piston and said handle;

wherein said assembly is configured to allow the user to urge said handle downwardly toward said table having the user simultaneously stretching said spring biasing member and compressing said piston such that the user is trained in the sport of arm wrestling;

said rod having a principle end and an alternative end;

said rod being elongated;

said principle end of said rod being coupled to said handle; and said alternative end of said rod being coupled to said piston such that said rod extends through a groove in a top of said table.

13. An exercise assembly configured to allow a user to practice the sport of arm wrestling, said assembly comprising:

a table having a plurality of legs coupled to and extending downwardly from a bottom side of a top of said table, each of said plurality of legs being positioned proximate to an associated one of four corners of said top of said table, a lower end of each of said plurality of legs abutting a support surface such that said top of said table is supported above the support surface;

said top of said table having a slot extending through a top side of said top of said table and said bottom side of said top of said table, said slot extending between each of a first lateral edge and a second lateral edge of said top of said table;

a support arm having a top end and a bottom end, said support arm extending upwardly through said top of said table such that said support arm is positioned proximate to a middle of a rear edge of said top of said table, said bottom end of said support arm abutting the support surface and said top end of said support arm being spaced upwardly from said top of said table;

a retention arm having a coupled end and a free end, said retention arm having a bend thereon such that said retention arm has an L-shape, said coupled end of said retention arm insertably receiving said top end of said support arm such that said free end of said retention arm is directed forwardly from said support arm;

a pair of plates, a first plate of said pair of plates being coupled to said free end of said retention arm;

a spring biasing member coupled between said first plate and a second plate of said pair of plates such that said spring biasing member is positioned above said top of said table;

a handle mount having a first end and a second end, said handle mount having a pair of bends thereon such that said handle mount has a U-shape, a central arm of said handle mount being coupled to said second plate;

a rear arm of said handle mount being curved such that said first end of said handle mount is directed toward said second end of said handle mount, said rear arm of said handle mount having a length being greater than a length of a front arm of said handle mount;

a handle having an outer surface extending between a primary end and a secondary end of said handle, said outer surface of said handle flaring outwardly proximate to a center of said handle such that said center of said handle has a diameter being greater than a diameter of each of said primary and secondary ends of said handle;

each of said primary and secondary ends of said handle being coupled to an associated one of said first and second ends of said handle mount, said handle being oriented at an angle with respect to said spring biasing member and configured such that the user's hand and forearm are positioned in the convention of arm wrestling when the user grips said handle;

a piston arm having a leading end and a following end, said leading end of said piston arm being rotatably coupled to a front side of said support arm such that said piston arm is positioned beneath said top of said table;

a piston rotatably coupled to said following end of said piston arm such that said piston extends upwardly from said piston arm toward said bottom side of said top of said table;

a rod having a principle end and an alternative end, said rod being elongated, said principle end of said rod being coupled to said handle, said alternative end of said rod being coupled to said piston such that said rod extends through said slot in said top of said table; and wherein said assembly is configured to allow the user to grip said handle and to urge said handle downwardly toward said table having the user simultaneously stretching said spring biasing member and compressing said piston such that the user is trained in the sport of arm wrestling.

* * * * *